United States Patent [19]

Bush

[11] 4,442,955

[45] Apr. 17, 1984

[54] CHILD-RESISTANT AND TAMPER INDICATING OVERCAP

[75] Inventor: Randall G. Bush, Evansville, Ind.

[73] Assignee: Sunbeam Plastics Corporation, Evansville, Ind.

[21] Appl. No.: 385,829

[22] Filed: Jun. 7, 1982

Related U.S. Application Data

[63] Continuation-in-part of Ser. No. 163,939, Jun. 30, 1980, Pat. No. 4,333,589.

[51] Int. Cl.[3] ..... B65D 83/14; B67D 5/32

[52] U.S. Cl. ..... 222/153; 222/402.11; 222/402.13

[58] Field of Search ..... 222/153, 402.11–402.13, 222/182

[56] References Cited

U.S. PATENT DOCUMENTS

| | | | |
|---|---|---|---|
| 3,373,908 | 3/1968 | Crowell | 222/402.13 |
| 3,622,052 | 11/1971 | Gach | 222/402.11 |
| 3,734,354 | 5/1973 | Gach | 222/402.11 |
| 3,744,682 | 7/1973 | Blank | 222/402.11 |
| 3,967,760 | 7/1976 | Marcon | 222/153 |
| 4,067,482 | 1/1978 | Vogel et al. | 222/402.13 |
| 4,333,589 | 6/1982 | Bush | 222/402.13 |

*Primary Examiner*—H. Grant Skaggs

*Attorney, Agent, or Firm*—Fisher, Gerhardt, Crampton & Groh

[57] ABSTRACT

A child-resistant and tamper indicating overcap for a pressurized container, such as an aerosol can, having a valve with an axially protruding discharge nozzle which must be depressed to actuate the valve for discharging the contents of the container. The overcap includes a valve guard slidable between a radially outer position in which a portion of the guard overlies the nozzle for preventing actuation thereof and an inner position in which the nozzle can be depressed. A removable tamper indicating tab is connected to the guard to prevent movement of the guard to an actuating position until it is removed. The overcap includes a resilient portion of the guard which biases the guard toward its outer position and which must be overcome in order to move the guard to its inner position and which returns the guard to its outer position when the guard is released.

6 Claims, 12 Drawing Figures

Fig-1
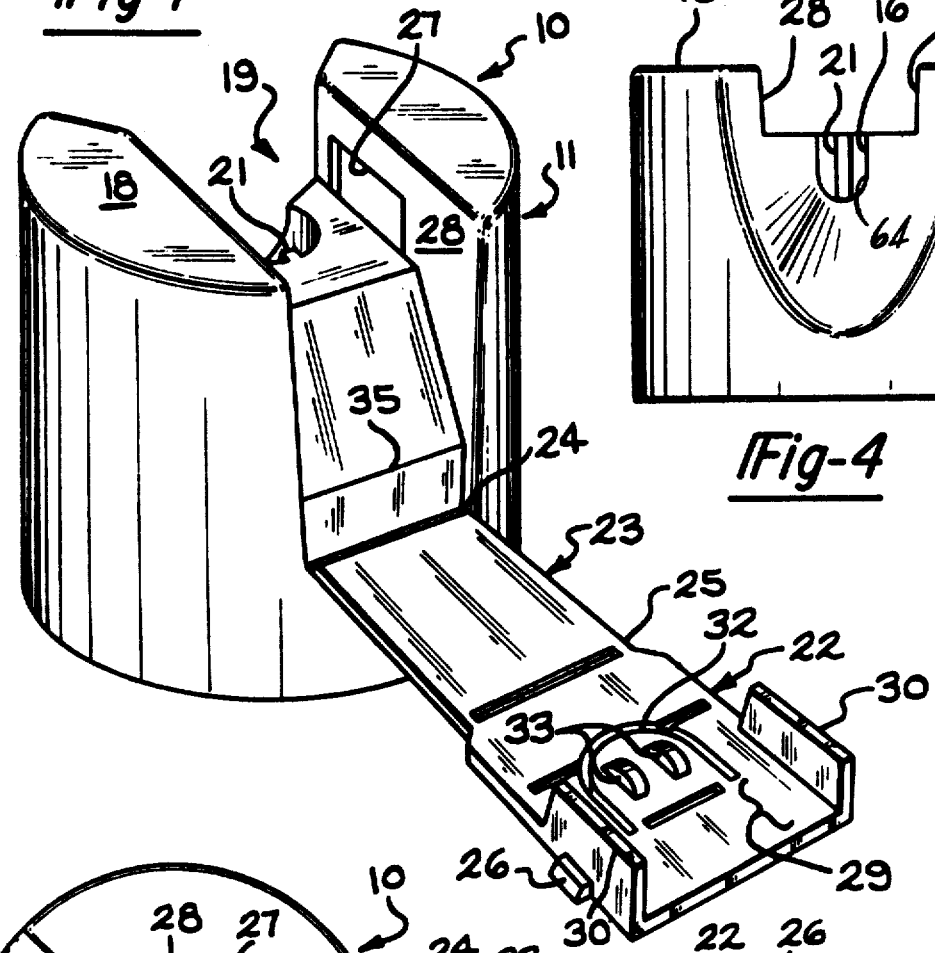
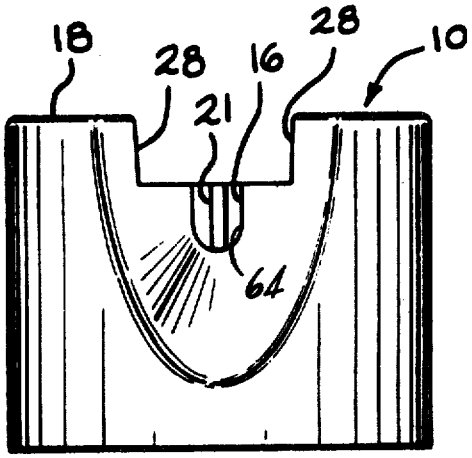
Fig-4
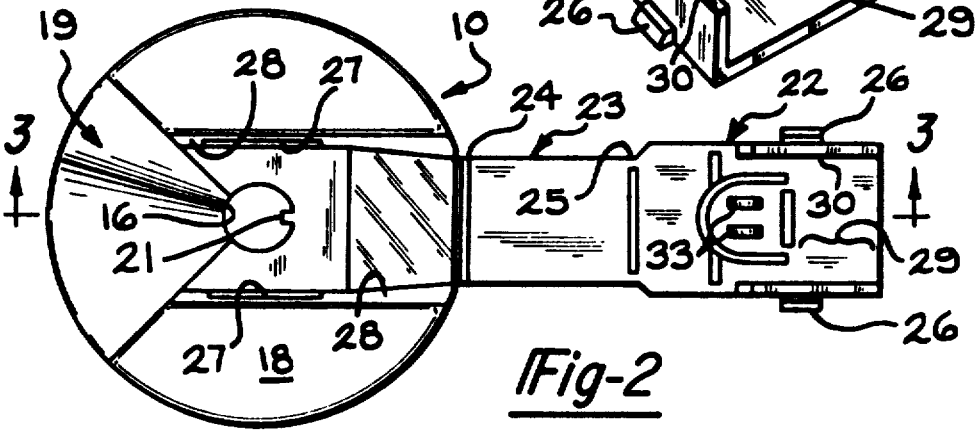
Fig-2
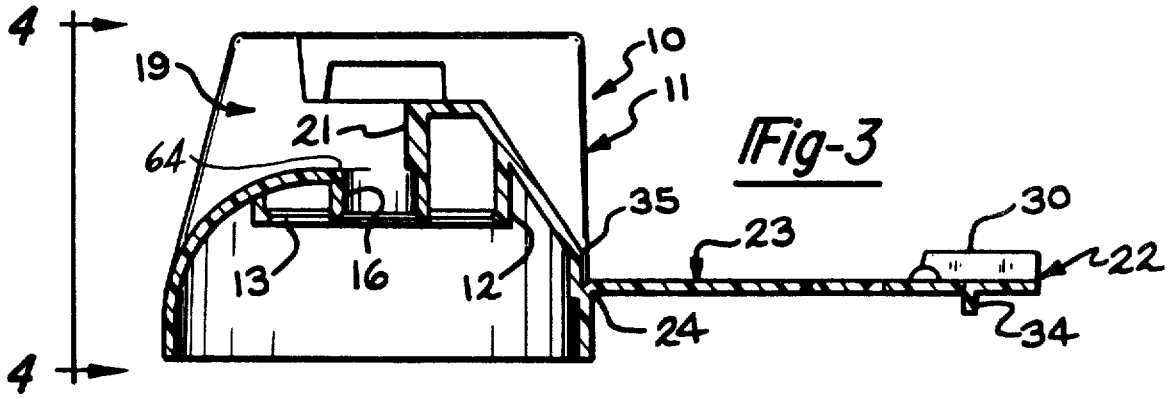
Fig-3

Fig-5
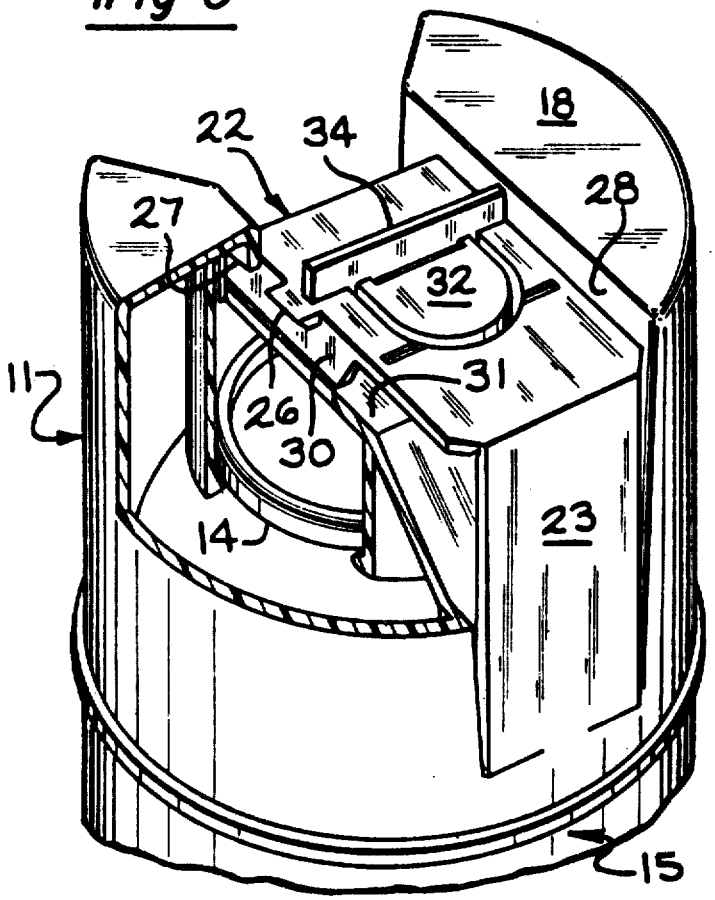
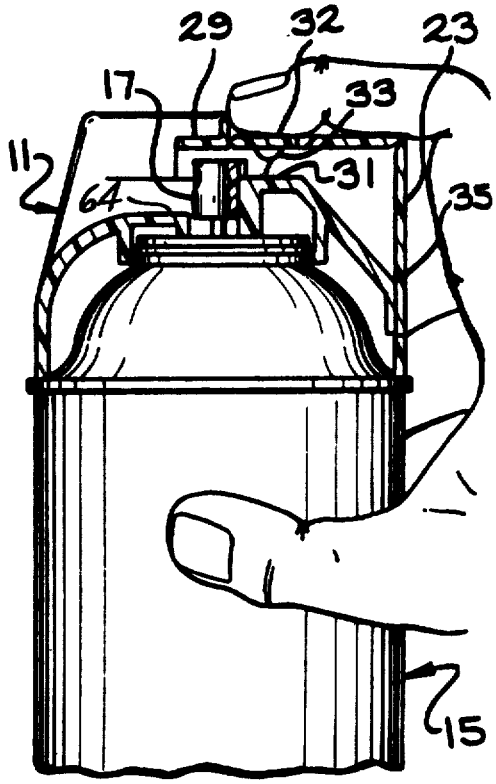
Fig-7
Fig-6
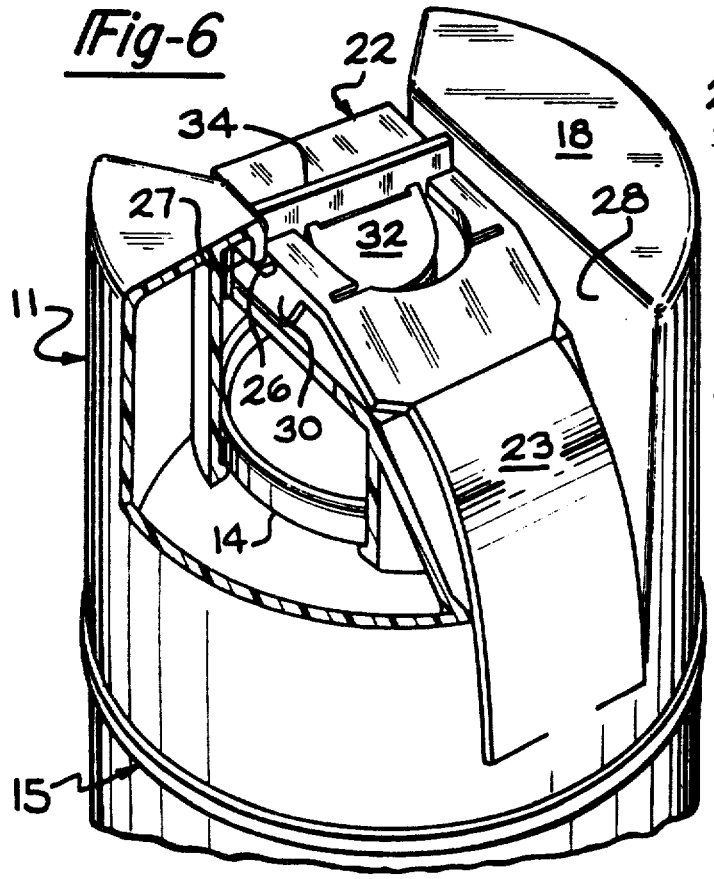
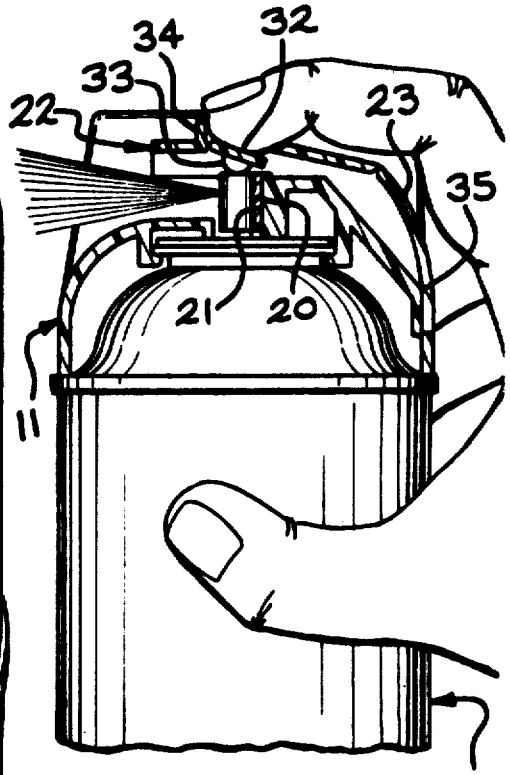
Fig-8

CHILD-RESISTANT AND TAMPER INDICATING OVERCAP

This is a continuation-in-part application of U.S. Pat. application Ser. No. 163,939 filed June 30, 1980, now U.S. Pat. No. 4,333,589 granted June 8, 1982.

This invention relates to caps or overcaps for pressurized containers and more particularly for overcaps having child-resistant and tamper indicating features.

Because so many products commonly used in households, such as paints, insect sprays, deodorants, room fresheners, etc., are packaged in pressurized containers having readily actuatable dispensing valves, it is important that containers of this type be provided with means for rendering them child-resistant.

It has been customary for many years to equip pressurized containers of this type with what are called "overcaps" many of them having central finger depressions which guide a user's finger to a position for depressing the centrally located valve-actuating and spray directing nozzle to discharge the contents from the can. Therefore, many of the suggested child-resistant overcaps have generally followed this same construction with added elements to provide the child-resistant feature.

Most of the child-resistant overcaps, for example, the cap disclosed in Corba U.S. Pat. No. 4,171,758, require what Corba calls ". . . a conscious action to return the actuator to a child-safe condition".

A number of other overcaps for containers of this type have included members which obstruct access to the valve-actuating nozzle except by fingers of length or width greater than those usually possessed by a small child of tender years, say, five or six. It is apparent, however, that some of these actuators could not be utilized by even an adult or an older child who had small hands with short or narrow fingers.

In addition to the child-resistant features, it is desirable also to provide a tamper indicating feature so that any attempt to open the container once it has been filled is indicated by some means which can be observed. Also it is desirable that the child-resistant features remain operable for repeated openings and closings whereas the tamper indicating arrangement is required to operate only the first time that the container is opened.

With respect to such tamper indicating means, the prior art has many different arrangements including those with portions of the cap that must be removed in order to complete the opening sequence. In none of these arrangements, does the removable portion have any utilitarian purposes other than the indicating operation.

It is an object of the present invention to provide a child-resistant overcap for pressurized containers in which tamper indicating means prevent placing the overcap in a condition by which the contents of the container can be dispensed until the tamper indicating means are removed.

Still another object of the invention is to provide an overcap in which the tamper indicating means are positioned to obstruct the dispensing passages from the container.

Another object of the invention is to provide a child-resistant and tamper indicating closure in which the tamper indicating means are moved closer to the dispensing passage to form a greater obstruction and to more completely conceal the passage.

Another object of the instant invention is to provide a child-resistant overcap for a pressurized container comprising a valve guard which is movable between valve-guarding position and valve-actuating position and which includes resilient means biasing the valve guard toward guarding position whereby, after movement to valve-actuating position by an adult or older child, the valve guard automatically is restored to valve-guarding or child-resistant position without the necessity for a conscious action on the part of the user.

It is yet another object of the instant invention to provide an overcap for a pressurized container having a centrally located and upwardly extending valve nozzle which comprises a valve guard that is radially movable between an outer, valve-guarding or child-resistant position and an inner valve-actuating position, and an integral resilient means which biases the valve guard toward the outer valve-guarding or child-resistant position.

A further object of the instant invention is to provide such a child-resistant overcap for a pressurized container with a valve guard, a tamper indicating tab and resilient means, all of which are integral with the overcap structure.

BRIEF DESCRIPTION OF THE DRAWINGS

FIG. 1 is a view in perspective of an overcap embodying the invention with its parts shown in the position in which they initially are molded;

FIG. 2 is a top plan view of the overcap embodying the invention as illustrated in FIG. 1 and shown on a smaller scale;

FIG. 3 is a vertical sectional view taken along the line 3—3 of FIG. 2;

FIG. 4 is a front view in elevation taken from the position indicated by the line 4—4 of FIG. 3;

FIG. 5 is a view in perspective, with parts broken away, showing an overcap embodying the invention in position on a pressurized container which is fragmentarily shown, with its valve guard elements in valve-guarding position;

FIG. 6 is a view, similar to FIG. 5, but showing the valve guard in its valve-actuating position;

FIG. 7 is a diametric, vertical sectional view of an overcap embodying the invention in place on a pressurized container, the overcap and its valve guard being illustrated in the valve-guarding position as also shown in FIG. 5;

FIG. 8 is a view similar to FIG. 7 but showing the overcap of the invention with its valve guard in valve-actuating position as also is shown in FIG. 6;

Figure 9:
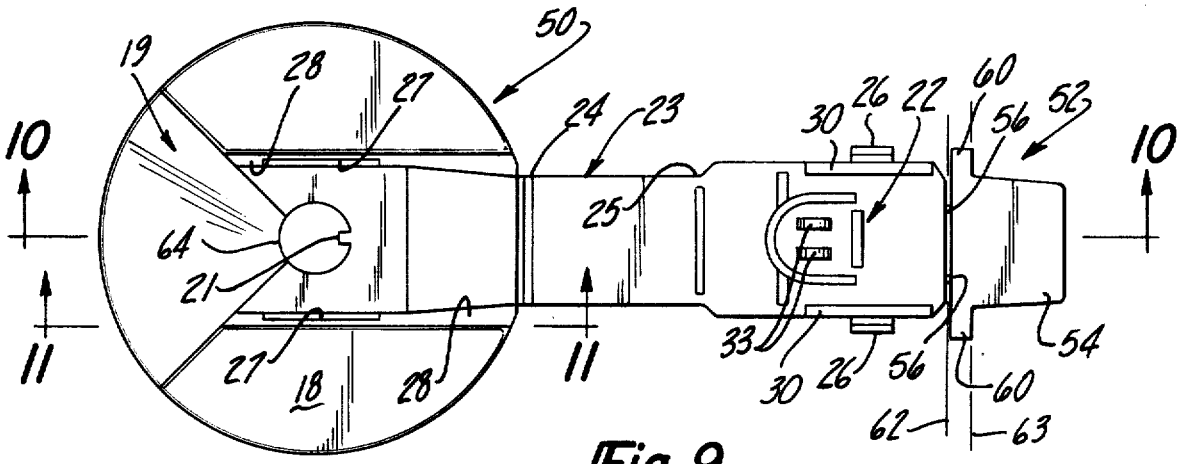
FIG. 9 is a view similar to FIG. 2 showing another embodiment of the invention incorporating tamper indicating features.
Figure 10:
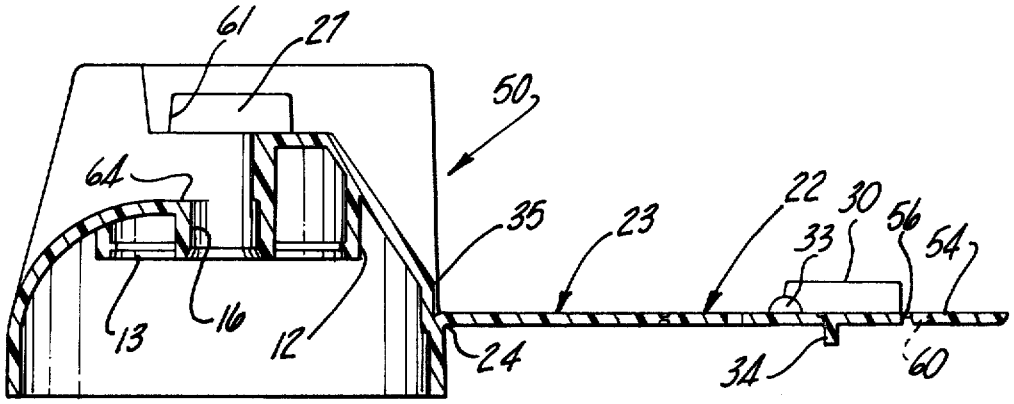
FIG. 10 is a cross-sectional view taken on line 10—10 in FIG. 9.

An overcap embodying the invention, indicated by the reference number 10 has a generally cup-shaped body 11, the body 11 having an inner annular skirt 12 at the margin of which there is an inwardly extending lip 13. The lip 13 is of such size as to snap over a conventional valve assembly retaining seam 14 (see FIGS. 5–8, inclusive), of a conventional pressurized container 15. The overcap body 11 has a central vertical bore 16 which is of such size as to fit around a conventional valve discharge nozzle 17. The overcap body 11 has a configuration which provides a closed top 18 and inner walls defining a finger depression 19 which extends diametrically across the overcap 10 and intersects the nozzle bore 16 so that, when the overcap 10 is in position on the container 15, the nozzle 17 protrudes upwardly into the depression 19. The nozzle 17 has a vertical key way 20 in which a key 21 at the side of the nozzle bore 16 engages to orient the nozzle 17 in the finger depression 19 so that the spray of contents is properly directed as shown in FIG. 8.

An overcap embodying the invention comprises a combination of the foregoing structural elements which are known in the art with additional elements by which the overcap of the invention is rendered child-resistant in its normal condition, which readily can be actuated by an adult or an older child to provide for actuation of the valve and discharge of the contents of the container and which automatically restores itself to child-resistant condition immediately upon disengagement or release by a user.

The overcap 10 of the invention includes a valve guard 22 integrally molded with a resilient web 23 and integrally connected by the web 23 to the overcap body 11 by a hinge portion 24. The hinge portion 24 extends generally tangentially to the body 11 at a level beneath that of the finger depression 19. A second hinge portion 25 is also formed at the time of initial molding at the junction between the guard 22 and the resilient web 23.

Because the entire overcap 10 consisting of the body 11, guard 22 and web 23 is integral when molded from a suitable tough resilient material, such as polypropylene resin, the fact that the web 23 and guard 22 extend horizontally from the body 11 when initially molded results in those parts wishing to return to that position relative to the body 11. As a result, when the guard 22 and resilient web 23 are swung upwardly and to the left (in a counter-clockwise direction) from the position shown in FIG. 3, the resilient web 23 biases the guard 22 to return to the position shown in FIG. 3.

However, the guard 22 has a pair of laterally extending tabs 26 which snap into recessed guide ways 27 formed in inner walls 28 which define the sides of the finger depression 19. The engagement of the tab 26 in the guide ways 27 serves not only to retain the guard in its operating position, as illustrated in FIGS. 5–8, inclusive, but it also functions to guide the guard in its movement radially between the valve-guarding position of FIGS. 5 and 7 and the valve-actuating position of FIGS. 6 and 8.

The guard 22 has a portion at its free end, indicated by the bracket 29, which is the innermost portion of the guard 22 after the guard has been swung up and over into its operative location in the finger depression 19. As best can be seen in FIG. 7, this innermost portion 29 of the guard 22 overlies the valve nozzle 17 when the valve guard is in its outer position. In this position of the guard 22, its side rails 30 slide on a flat portion 31 of the bottom of the finger depression 19. As a result, downward movement of the innermost portion 29 of the guard 22 is prevented when the guard 22 is in the position shown in FIGS. 5 and 7.

The guard 22 also has a generally semi-circular depressable portion 32 forming a valve actuator. The valve actuator 32 is depressable in all positions of the guard 22 and it overlies the top of the nozzle 17 to engage it when the guard 22 is in valve-actuating position as illustrated in FIGS. 6 and 8. A pair of ears 33 are molded on the underside of the depressable portion 32 so that when the portion 32 is pressed downwardly by the finger of the user, as shown in FIG. 8, the ears 33 engage the top of the nozzle 17 to actuate the valve for the discharge of material.

In order that a user may move the guard 22 from the position shown in FIGS. 5 and 7 to the valve-actuating position shown in FIGS. 6 and 8, the guard 22 also has an element 34 which extends upwardly when the guard is in operating position and is engageable by the end of a finger of a user in order that the user may slide the guard from the valve-guarding position of FIGS. 5 and 7 to the valve-actuating position of FIGS. 6 and 8.

It will be observed by comparing FIGS. 5 and 7 with FIGS. 6 and 8, respectively, that when the guard 22 is moved into valve-actuating position, the resilient web 23 is flexed inwardly over a sharp edge 35 of a part of the bottom of the finger depression 19.

When the user releases the guard 22 by withdrawing his finger from the position illustrated in FIG. 8, the flexure of the resilient web 23 seeking to return to the position illustrated in FIGS. 5 and 7 and its "memory" tending to return it to its initially molded position as shown in FIGS. 1–3, inclusive, causes the guard 22 to be immediately moved outwardly to valve-guarding position thus restoring the overcap to its child-resistant condition.

Referring now to FIGS. 9–12, another embodiment of the invention is illustrated in which an overcap 50 incorporates the child-resistant features of the overcap 10 and in addition tamper indicating means designated generally at 52. Except for the tamper indicating means 52, the overcap 50 is identical to the child-resistant overcap 10 illustrated in FIGS. 1–8.

The tamper indicating means 52 is in the form of a tab 54 molded integrally with the end of guard 22 and is connected thereto through means of frangible hinge elements 56.

Figure 11:
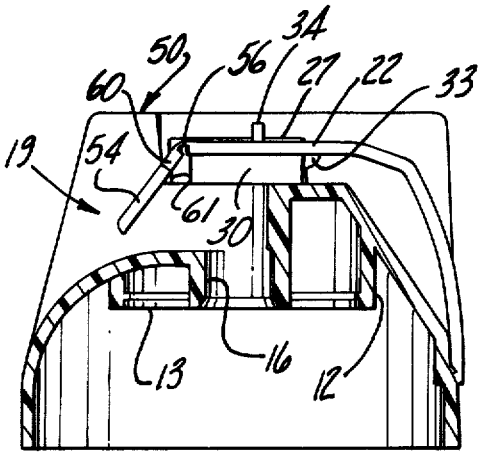
FIG. 11 is a view of the overcap taken generally on line 11—11 showing the overcap in its assembled condition ready for application to a container.
Figure 12:
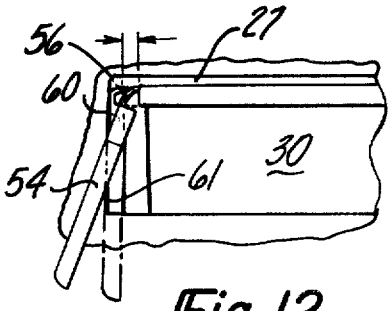
FIG. 12 is an enlargement of a portion of FIG. 11 showing the details of the tamper indicating means.

The tab element 54 is provided with a pair of lock portions 60 which in the assembled condition of the overcap 50, as viewed in FIG. 11, are disposed in the pair of recesses forming the guide ways 27. Disposition of the lock elements 60 in the guide ways 27 is such that movement of the guard 24 from its valve-guarding position illustrated in FIG. 11 to a valve-actuating position, as seen in FIG. 8, is prevented by the interference of the lock elements 60 with the end walls 61 of the opening forming the guide ways 27. Under these conditions, the tab 54 is bent downwardly at an angle relative to the remainder of the guard 22 along a transverse hinge line indicated at 62 in FIG. 9 and passing through the hinge elements 56. Any effort to move the guard 22 to the left, as viewed in FIG. 11, is resisted by the lock elements 60 which act along a transverse line indicated at 63 in FIG. 9 which is spaced from the hinge line 62. The spacing of the lines 62 in which the hinge elements 56 act and the line 63 in which the lock elements 60 act, causes the tab 54 to deflect further and swing in a counter-clockwise direction to the broken line position shown in FIG. 12 to move the tab 54 closer to the bore of recess 16 which receives the actuating nozzle 17. The recess 16 extends generally axially of the overcap 50 and is provided with an axially extending dispensing passage disposed diametrically opposite to the key 21. In the condition seen in FIG. 11, the tab 54 obstructs the dispensing passage and also serves to conceal the valve actuating nozzle 17 from view.

Any effort to slide the valve guard 22 to the left, as viewed in FIG. 11, is resisted by the lock elements 60 making it necessary to remove the tab 54 prior to placing the container in a condition in which dispensing of the container contents can occur. This is accomplished by folding the tab 54 upwardly and twisting the frangible hinge elements 56 to separate the tamper indicating tab 54 from the remainder of the overcap 50. In this manner, the overcap is placed in a condition making it possible to actuate the nozzle 17 and dispense contents from the container. At the same time, an observer is given evidence that the container has been placed in a condition permitting dispensing of the contents. When a number of containers with overcaps are displayed in retail outlets, any overcap which has the tab 54 removed is easily distinguished from the remainder of the containers and is suspect as having been tampered with and some of its contents possibly used.

A child-resistant and tamper indicating overcap for pressurized containers having an axially movable dispensing valve has been provided in which the overcap has a valve guard movable between a valve-guarding and a valve-actuating position and is further provided with an indicator tab which prevents movement of the valve guard to the valve-actuating position until it is removed. Until such time as the tab is removed, it not only prevents actuation of the valve but it also obstructs the passage from which the contents of the container are dispensed from the nozzle. Upon removal of the tab, the valve can be actuated and at the same time there is visible evidence that the overcap has been placed in a condition permitting dispensing of the contents of the container.

The embodiments of the invention in which an exclusive property or privilege is claimed are defined as follows:

1. A child-resistant and tamper indicating overcap for a pressurized container of the type having an axially movable dispensing valve at the center top of the container, said overcap comprising: a generally cup-shaped body having a depending skirt with an annular lip adapted to be fastened to a container, a valve receiving cavity formed in said body, a finger depression extending diametrically across the top of said body and intersecting said valve receiving cavity, a valve guard unitary with said body and slidably mounted in said finger depression for movement radially of said valve receiving cavity between a valve-guarding position and a valve-actuating position, an indicator tab, hinge means connecting said indicator tab to said valve guard for relative hinging movement, lock means on said tab engageable with said body to prevent radial movement of said valve guard to said valve actuating position, said hinge means connecting said tab to said guard being frangible to permit detachment of said tab from said guard to permit movement of said guard to said valve-actuating position and give visible evidence of tampering.

2. The child-resistant and tamper indicating overcap of claim 1 and further comprising a dispensing passage extending radially from said valve receiving cavity, said tab being disposed at an angle relative to said valve guard to obstruct said dispensing passage when said valve guard is in said valve-guarding position.

3. A child-resistant and tamper indicating overcap for a pressurized container of the type having an axially movable dispensing valve at the center top of the container, said overcap comprising: a generally cup-shaped body having a depending skirt with an annular lip adapted to be fastened to a container, a valve receiving cavity formed in said body, a dispensing passage extending radially from said valve receiving cavity, a finger depression extending diametrically across the top of said body and intersecting said valve receiving cavity, a valve guard unitary with said body and slidably mounted in said finger depression for movement between a valve-guarding position and a valve-actuating position, an indicator tab, means connecting said indicator tab to said valve guard, lock means on said tab engageable with said body to prevent movement of said valve guard to said valve actuating position, said tab being disposed at an angle relative to said valve guard to obstruct said dispensing passage when said valve guard is in said valve-guarding position, and complementary guide means on said body and said valve guard, said lock means being engageable with said guide means on said body to deflect said tab to its passage-obstructing position, said means connecting said tab to said guard being frangible to permit detachment of said tab from said guard to permit movement of said guard to said valve-actuating position and give evidence of tampering.

4. The child-resistant and tamper indicating overcap of claim 3 wherein said lock means co-act with said guide means on said body to deflect said tab toward said dispensing passage as said valve guard is urged away from its valve-guarding position.

5. The child-resistant and tamper indicating overcap of claim 3 wherein said guide means on said body are a pair of openings at opposite sides of said finger recess, said lock means including a pair of lock elements extending in opposite directions from said tab and into said recesses, respectively.

6. A child-resistant and tamper indicating over-cap for a pressurized container of the type having an axially movable dispensing valve at the center top of the container, said overcap comprising: a generally cup-shaped body having a depending skirt with an annular lip adapted to be fastened to a container, a valve receiving cavity formed in said body, a finger depression extending diametrically across the top of said body and intersecting said valve receiving cavity, a valve guard unitary with said body and slidably mounted in said finger depression for movement between a valve-guarding position and a valve-actuating position, an indicator tab, hinge means connecting said indicator tab to said valve guard, lock means on said tab engageable with said body to prevent movement of said valve guard to said valve actuating position, said indicator tab being deflectable along a hinge line extending transversely to the direction of movement of said valve guard, said lock means being oppositely extending lock elements engageable with said body member at opposite sides of said finger depression, said lock elements being disposed along a transverse line parallel to and spaced from said hinge line to pivot said indicator tab toward said valve receiving cavity upon movement of said valve guard towards said valve-actuating position, said means connecting said tab to said guard being frangible to permit detachment of said tab from said guard to permit movement of said guard to said valve-actuating position and give evidence of tampering.

* * * * *